United States Patent [19]

Wood

[11] Patent Number: 4,475,731

[45] Date of Patent: Oct. 9, 1984

[54] PROGRAMMABLE, MECHANICAL SYSTEM FOR FEEDING CUT SHEET PAPER TO A PRINTER

[75] Inventor: Harold Wood, Herkimer, N.Y.

[73] Assignee: Centronics Data Computer Corp., Hudson, N.H.

[21] Appl. No.: 450,806

[22] Filed: Dec. 17, 1982

[51] Int. Cl.[3] ..... B65H 5/26

[52] U.S. Cl. ..... 271/9; 271/109; 271/164; 400/629

[58] Field of Search ..... 271/9, 109, 164; 400/624, 625, 629

[56] References Cited

U.S. PATENT DOCUMENTS

| | | | |
|---|---|---|---|
| 3,936,042 | 2/1976 | Smith | 271/9 |
| 3,947,015 | 3/1976 | Funk | 271/9 |
| 3,977,666 | 8/1976 | Suzuki | 271/9 |
| 4,222,557 | 9/1980 | Wu | 271/4 |
| 4,248,415 | 2/1981 | Steinhilber | 271/9 |
| 4,253,652 | 3/1981 | Steinhilber | 271/8 R |
| 4,262,817 | 4/1981 | Fish | 271/9 X |
| 4,265,440 | 5/1981 | Shibazaki | 271/9 |
| 4,285,607 | 8/1981 | Steinhilber | 271/9 X |
| 4,324,480 | 4/1982 | Nomura | 271/9 |
| 4,417,282 | 11/1983 | Yamamoto | 271/9 X |

*Primary Examiner*—Richard A. Schacher
*Attorney, Agent, or Firm*—Kenway & Jenney

[57] ABSTRACT

A mechanical system for feeding cut sheet paper to a printer from one of several cassettes. A mechanical selector is mounted in each cassette so that it can drive a paper feed roll mounted in that cassette. The cassettes include insert guides which allow each cassette to be replaceably mounted in at least one side rail secured on the printer. The side rail has guides that receive and automatically locate each cassette on the printer with a simple "drop in" engagement. The side rail supports a gear train or an equivalent power transmission arrangement that has a common drive and extends to all of the cassettes. A power input gear of each selector engages an associated gear of the gear train. The selectors each include a combination mechanism that allows the selector to transmit power only after the drive shaft has supplied a programmed pattern of rotations and counter-rotations to the selectors. A unique association between the programmed pattern of rotations and the selection of a given cassette is established either by varying the "combinations" of the selectors or by using the same combination but varying the gear ratio between the drive shaft and the power input gear of the selector.

24 Claims, 11 Drawing Figures

PROGRAMMABLE, MECHANICAL SYSTEM FOR FEEDING CUT SHEET PAPER TO A PRINTER

THE BACKGROUND OF THE INVENTION

This invention relates in general to high speed printing systems for use in conjunction with computers. More specifically, it relates to a mechanical arrangement for selecting cut sheet paper from only one of several cassettes each of which may hold a supply of a differently sized paper.

In many printing applications, particularly office printers used as the output device of a word processing system or other host data source, it is highly desirable to be able to print on cut sheet paper products having a variety of sizes or other characteristics. For example, it is frequently desirable to be able to print on standard letter size paper, legal size paper, or envelopes. Usually each of these products is held in a separate cassette and all of the cassettes can feed their contents to the printhead of the printer. It is also known to employ a feed roll in the cassette which strips the uppermost sheet from the supply and directs it into a common paper feed arrangement leading to the printhead. This approach requires, however, that there be some arrangement for feeding paper from only a selected one of these cassettes.

One arrangement in the prior art has been to move the entire set of cassettes relative to a single, fixed feed roller until the appropriate cassette is positioned for feeding its paper to the printer. This arrangement has certain time and cost disadvantages associated with moving a comparatively large assembly in a precise manner. There are also design difficulties in engaging and disengaging the feed roller from the paper supply held in the selected cassette. Another approach, where there are only two cassettes, has been to mechanically switch a common feed roller between the two cassettes. This arrangement has the obvious limitation that it is only useful for the feeding one of two types of cut sheet paper. It is also comparatively complex mechanically.

The most commonly used selection system is to electrically activate the feed roll of the selected cassette. U.S. Pat. No. 3,936,042, for example, selectively engages feed rolls of the cassettes through a magnetic clutch. U.S. Pat. No. 4,258,607 also shows a system of this general type. The feed rolls of each cassette can be driven by a separate motor and controlled electrically by the machine or data source controlling the printing operation. Alternatively, a common conveyor belt for the paper can engage friction wheels associated with each cassette which are in turn selectively coupled to the cassette feed rolls. This '607 patent, however, offers no details as to how one would achieve this coupling other than through the obvious expedient of separate, electrically operated clutches. In general, electrical cassette selection systems of this type are relatively costly to manufacture and more cumbersome to install and use than a mechanical system. For example, such a system may require multiple motors or clutches and a significant redesign of existing cut sheet printers. In use, electrical selection systems may require an operator to make electrical connections when a cassette is replaced or resupplied or require multiple controls for the printer and feed system.

Ideally, the cassettes should also be easily replaceable with a simple sliding insertion or removal to facilitate the selection of different types of paper or the replenishment of the paper supply held in the cassette. The paper feed system should also be compatible with known printers, and preferably should involve a minimum modification of existing systems. Related to the foregoing, it is desirable that all of the cassettes have a common drive mechanism. Also, of course, it is important that the system feed paper reliably and shift from one cassette to another during a printing operation with a minimum delay. While these design considerations are well known in the industry, no purely mechanical paper feed system heretofore has been able to simultaneously satisfy all of these criteria.

It is therefore a principal object of this invention to provide a paper feed system having multiple cassettes each holding a different type of cut sheet paper which reliably feeds paper from only a selected one of the cassettes with no electrical connection between the printer and the feeder.

Another object of the invention is to provide a paper feed system where the selection mechanism is programmable to provide a high degree of flexibility and yet is purely mechanical in nature.

A further object of this invention is to provide a paper feed system with the foregoing advantages where there is a common drive for all of the cassettes.

A further object of this invention is to provide a paper feed system where the cassettes are readily replaceable through a simple slip fit insertion that also engages and disengages the paper feed mechanism of each cassette from the drive system of the paper feed portion of the printer.

Still another object of the invention is to provide a multiple cassette paper feed system for a printer that is compact, comparatively cost effective, and requires a minimum modification of existing printers of this type to accommodate the selection system of the present invention.

SUMMARY OF THE INVENTION

The present invention concerns itself with a paper feed system for a printer and in particular a system for feeding cut sheet paper from one of a multiplicity of cassettes each holding a supply of one type of cut sheet paper. Each cassette has an associated paper feed roll that can feed the top sheet of the paper supply held in the cassette. Rotation of the feed roll in a forward direction feeds the top sheet. Each cassette also preferably includes some arrangement for urging the paper supply against the paper feed roll.

The cassettes are replaceably mounted in a pair of side rails which are in turn preferably supported on the printer. Each cassette has an insert guide on at least one side wall that is received in a mating slot mounted on the side rail(s) to precisely locate the cassette with respect to the printer. One of the side rails houses a drive system such as a gear train (or an equivalent drive mechanism such as a drive chain) that extends along the rail and is capable of transmitting power via a gear or gears to the feed roll of any one of the cassettes. The gear train operates in forward and reverse directions under the control of a host computer or data source which also controls the operation of the printer itself. Preferably a gear on the drive shaft for the main paper feed roll of the printer powers the gear train for the paper feed system.

A mechanical selector assembly is mounted in each cassette so that a power input gear of the selector automatically engages the gear train when the cassette is loaded into position in the side rails. Each selector has a housing that contains a combination mechanism such that after a preselected sequence of rotations and counter-rotations of the mechanism the selector transmits power from the gear train to the feed roll to feed paper from the selected cassette. If the proper sequence is not applied to the combination mechanism, the selector does not transmit power to the associated feed roll. Each selector housing preferably mounts a one-way roller clutch that engages the drive shaft of the feed roller at a "back" side of the selector at the interior of the cassette.

The selector includes a drive disc that rotates in unison with the input gear. The drive disc has a cam surface which, within at most one rotation, engages a cam projection on a first combination disc of the combination mechanism. Several of these discs, preferably three discs, are each mounted for free rotation about a common axis of rotation with the drive disc. The combination mechanism also includes cam projections carried on the faces of the combination discs which can transmit rotational motion from one disc to an adjacent disc when their adjacent cams abut one another. The configuration and spacing of the cam projections on the discs determines the pattern of rotations and counter-rotations (the "combination") that will place the selector in a power transmitting mode. Each disc also has an open recess formed on its outer periphery. When the discs have been rotated through a "proper" pattern of rotations and counter-rotations, the recesses of each disc are aligned with one another. This allows a spring loaded arm to fall into the aligned recesses which in turn allows a pawl to engage a mating recess formed on the drive shaft. This engagement transmits the rotation of the input gear and the drive disc to the housing of the selector as long as it continues to rotate in a forward or paper-feeding direction. Rotation of the housing in turn causes a rotation of the one-way clutch and the paper feed roll. Counter-rotation disengages the pawl and its recess engaging arm simply rides on the outer surfaces of the combination discs. Counter-rotation of all of the selectors through at least "n" rotations (where there are n-1 combination discs) places all of the discs of all of the selectors in a known position. Following this "initialization" procedure, a different pattern of rotations and counter-rotations can transmit power to another feed roller through a different selected mechanical selector.

The transmission of power to a selected cassette is uniquely associated with a given pattern of forward and reverse motions of the gear train in one of two ways. First, each selector can have a different combination (through different arrangements of the cam projections and recesses formed on the combination discs). Alternatively, the combination disc set of each selector can be identical with the unique association being provided by variations in the gear ratios interposed between the power input to the gear train and the input gear of the selector.

These and other features and objects of the present invention will be more fully understood from the following detailed description of the preferred embodiments which should be read in light of the accompanying drawings.

DETAILED DESCRIPTION OF THE PREFERRED EMBODIMENTS

Figure 1:
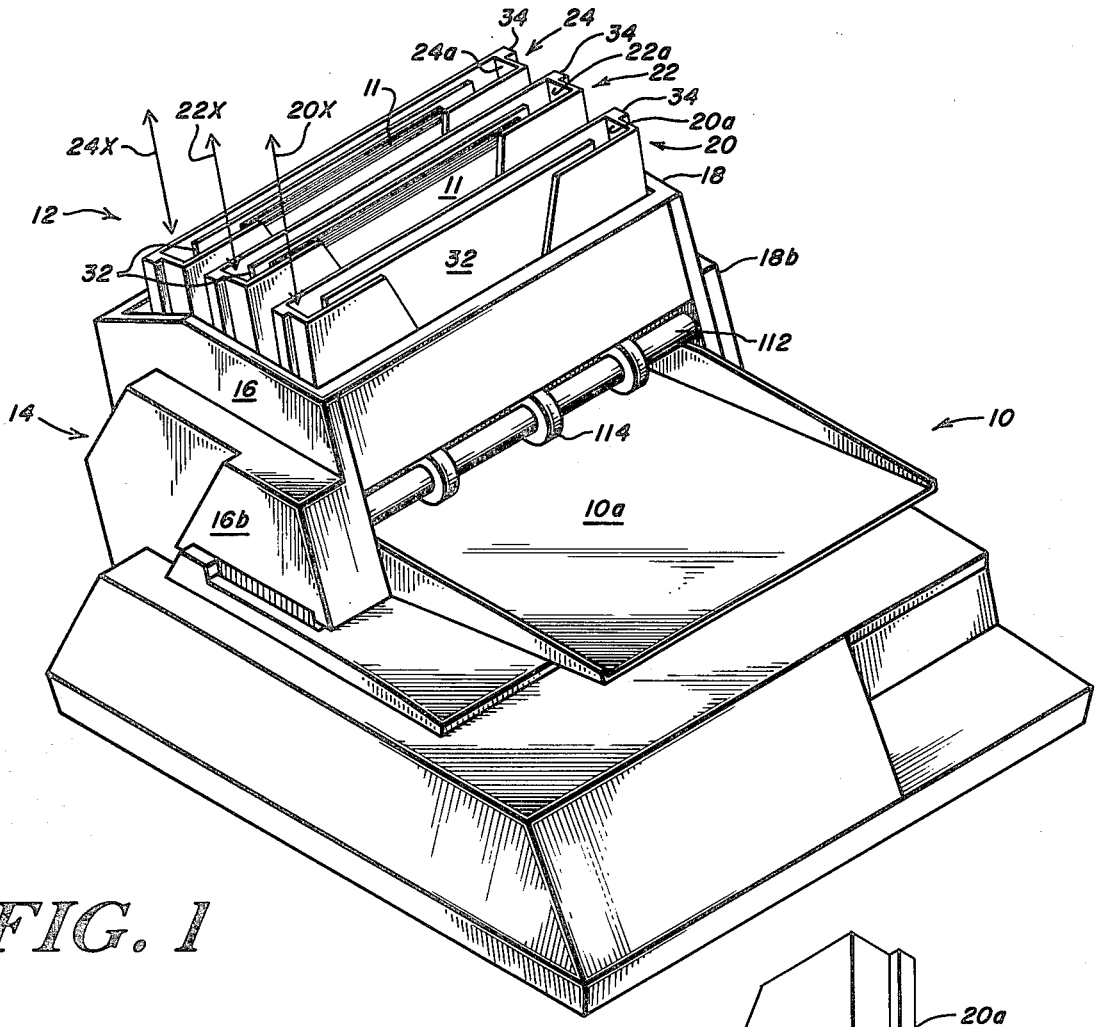
FIG. 1 is a perspective view of a printer utilizing a cut sheet, multiple cassette paper feed system according to the present invention.

FIG. 1 shows a high speed printer 10 suitable for use as an output device in conjunction with a computer. The printer 10 is designed to print on cut sheet paper 11, which can include ordinary letter size paper, legal size paper, and envelopes, directed to the printer by a cut sheet paper feed system 12 mounted on the printer. The paper feed system 12 includes a frame 14 having side rails 16 and 18 that hold cassettes 20, 22 and 24 in a generally vertical paper feeding position as shown. The cassette 20 may contain a supply of business size envelopes and cassettes 22 and 24 may each contain a supply of cut sheet paper, but of different sizes. While the contents of each cassette may vary, the cassettes themselves are preferably identical.

Figure 1A:
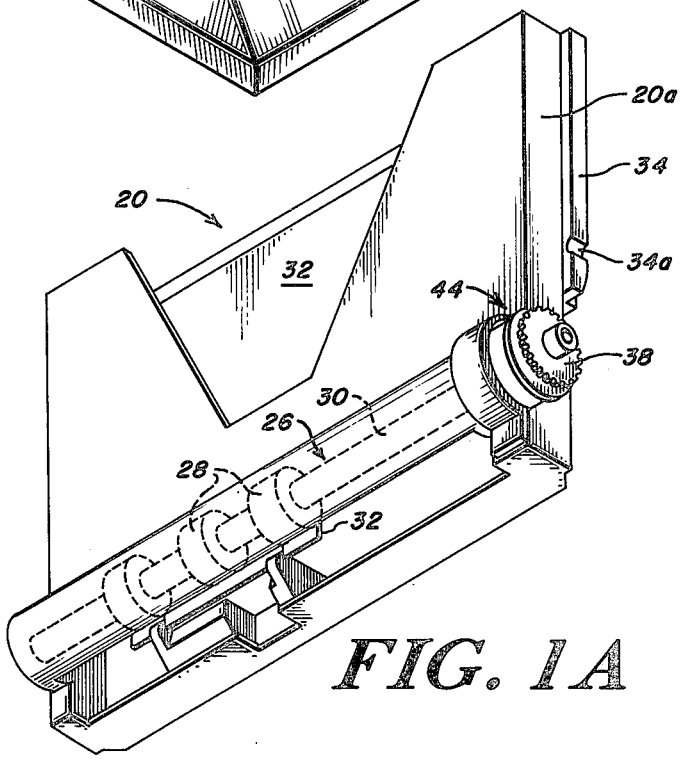
FIG. 1A is a detailed view in perspective of one of the cassettes shown in FIG. 1.

Each cassette, as is best seen in FIG. 1A, includes a paper feed roll 26 having a pair of high friction, paper engaging sleeves 28 and a drive shaft 30 which extends across the lower end of the associated cassette and is mounted for free rotation therein. Each cassette also includes a spring loaded press plate 32 which urges the supply of cut sheet paper 11 into engagement with the associated feed roll 26. The cassettes 20, 22 and 24 have a generally box-like configuration except that one end surface, the upper end as shown, and the front surface above the feed roll are removed to facilitate replenishing or changing the paper supply 11 in each cassette. The cassettes are preferably formed of a molded plastic material and dimensioned to hold a suitable supply of the paper.

Figure 10:
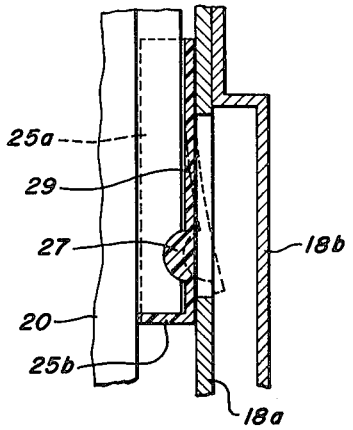
FIG. 10 is a detailed view in side elevation with portions in vertical section of the cassette guide slot taken along the line 9—9 in FIG. 9, but with the associated insert guide fully seated in the slot.

An insert guide 34 is formed integrally with a side wall 20*a*, 22*a*, 24*a* of the cassettes. The insert guide projects from the wall, extends generally along the direction of the paper held in the cassette, and has a generally rectangular cross-sectional configuration. A slot 25 secured on the inner wall of at least one of the side rails 16 and 18 receives each insert guide 34. Each slot 25 has a pair of parallel spaced apart side walls 25*a*, 25*a* that project inwardly toward the associated cassette and a bottom wall 25*b* that can act as a stop surface to limit the downward movement of the guide 34 and thereby locate the cassette vertically. The side walls 25*a*, 25*a* locate each cassette laterally with respect to the side rails and establish the vertical orientation of the cassette. A detent 27 formed on a leaf spring 29 is mounted in the slot 25 so that the detent will engage a mating recess 34*a* formed on the outer face of the guide 34 when the guide is fully seated in the slot 25. The engaged portion of the detent is shown in solid lines in FIG. 10 and the deflected, non-engaged position is shown in phantom. The wall 18*a* can have an opening behind the spring 29 (as shown in FIG. 10) to allow it to deflect, or the entire slot 25 can be spaced from the wall 18*a*. Any of a wide variety of other latch arrangements are also acceptable.

Spring action of the detent 27 provides a tactile feedback to an operator that the cassette is in its fully seated position. The engagement of the detent 27 in the recess 34*a* also holds the cassette in the paper-feeding position (as shown in FIG. 1) during operation. Each cassette is thus removed from or inserted into the guide rails with precision and reliability by a simple vertical sliding movement along the direction of the associated arrows 20*x*, 22*x* and 24*x* (FIG. 1). In other words, a cassette is loaded into the printer by simply dropping it into the frame 14 and removed by simply lifting it out of the frame. Major features and advantages of the present invention are that this "drop-in" loading of the cassette automatically (1) locates the cassette, (2) mechanically engages the cassette to a drive system that rotates its feed roll 26, and (3) requires no other operations such as electrical connections or activation of levers or switches to provide driving power to a selected one of the three cassettes 20, 22 and 24.

Figure 8:
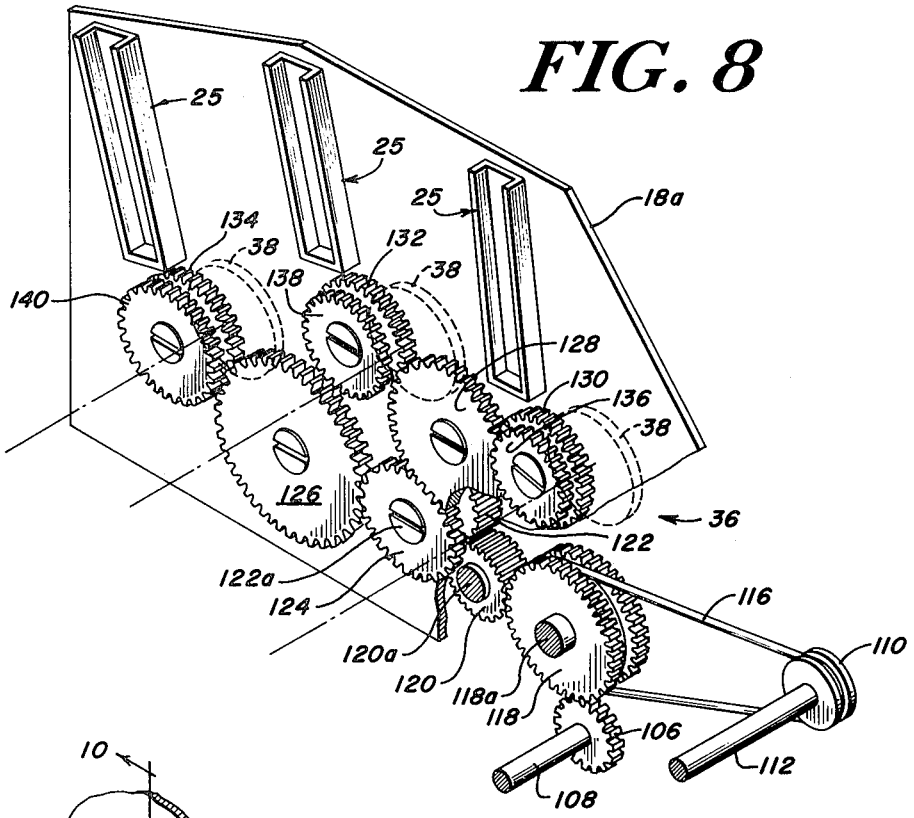
FIG. 8 is a detailed view in perspective of the gear train mounted in one of the side rails shown in FIG. 1 and used to transmit power to the selectors shown in FIGS. 1, 1A, and 2–4.
Figure 9:
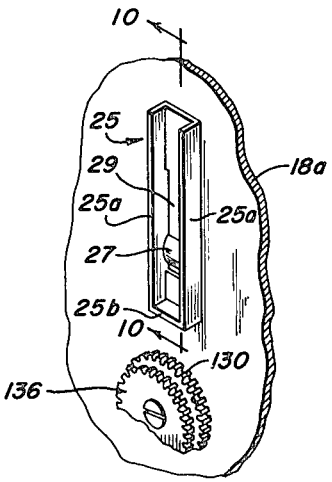
FIG. 9 is a detailed view in perspective of a guide slot shown in FIG. 8 for replaceably mounting one of the cassettes together with the associated portion of the gear train and surrounding wall portions of the side rail.

As is best seen in FIG. 8, the side rail 18 supports a drive train 36 that extends generally along the side rail to transmit power to any feed roll 26. As shown, the drive train 36 is powered by a drive gear 106 mounted at the end of the printer paper feed roll 108. The drive gear engages a first gear 118 of the gear train 36. The gear 118 is also grooved to receive an O-ring 116 that drives a pulley 110 mounted on one end of the shaft for the paper output roll 112. The roll 112 carries paper-engaging friction sleeves 114 (FIG. 1) to propel the cut sheet paper past the printhead of the printer 10 to an output tray 10*a*. The printer feed roll 108 is rotated by an electric motor (not shown) of conventional construction. Power is transmitted from this roll, which operates under the control of the host computer or data source, to the gear train 36 by the first gear 118. A shaft 118*a* supported within the side rail 18 supports the gear 118 for free rotation thereon. The gear 118 meshes with a second gear 120 mounted on a shaft 120*a* which in turn meshes with a third gear 122 secured on a shaft 122*a*. The gears 118, 120 and 122 are all located on the "outside" face of the inner wall 18*a*, between the inner wall 18*a* and an outer cover 18*b* (FIGS. 1 and 10). The shaft 122*a* of the gear 122, however, is a transfer shaft that extends through the inner wall 18*a* and also carries a gear 124 that is secured on the shaft 122*a*, but located at the interior side of the wall 18*a* adjacent the cassettes.

The gear 124 drives the remainder of the gear train 36 which is also located at the interior side of the inner wall 18*a*. Power is then distributed to the cassettes via gears 126 and 128 that mesh with gear 124. The gear 128 drives gears 130 and 132 and the gear 126 drives gear 134. Each of the gears 130, 132 and 134 is mounted for rotation in unison on a common shaft with power output gears 136, 138 and 140, respectively. These output gears are spaced inwardly from the wall 18*a* by the associated gears 130, 132 and 134. This spacing, together with the location of these gears on the wall 18*a*, places each of them in position to transmit power to the feed roll of the associated cassette when it is loaded into the slot 25 and fully seated. More specifically, a power input gear 38 carried with that cassette automatically engages the associated power output gear of the drive train 36. Another important aspect of this invention is that the gear train 36, through the proper selection of gear ratios or other equivalent modifications of the gear train, can rotate the output gears 136, 138 and 140 at the same or different speeds even though they have a common power input from gear 118. As shown, this speed variation derives from differences in the diameter of the gears 136, 138 and 140 which each engage one of the power input gears 38 of an associated cassette. As will be discussed in more detail below, in the preferred embodiment the gear train is of the type described above and the output gears each rotate at different peripheral speeds.

Of course, alternative drives can be used such as a chain drive that operates a gear or gears associated with each cassette or a drive shaft that extends along the side rail and transmits power to the cassettes by pulleys or gears. For the purposes of this invention, it is important that one common drive, operating under the control of the computer or machine that is also controlling the printer, can transmit power to any of the feed rolls 26 of the cassettes 20, 22 or 24.

Another principal feature of the present invention is a mechanical selector 44 that is mounted in each cassette to selectively transmit power from the associated gear 38 to the associated paper feed roll 26 of that cassette. The gear 38 is secured to one end 40*a* of a drive shaft 40 which carries a drive disc 50 at its other end 40*b*. The gear 38, drive shaft 40 and drive disc 50 form a power input train of the mechanical selector 44. In operation, rotation of the input power train in a "reverse" direction for a predetermined number of revolutions n will "initialize" all of the selector assemblies 44, 44, 44, that is, place them in a known initial condition. Once initialized, a preselected pattern of forward and reverse rotations (alternating directions and varying angular displacement) will cause a selected one of the three selectors 44 to enter into a power transmitting mode. Once in this mode, forward rotation of the drive shaft causes a forward rotation of the paper roll to feed the top sheet of paper 11 from the supply held in the selected cassette. The "selected" selector 44 will continue to feed paper from its cassette until there is a reverse rotation of the drive system and the selector.

Figure 2:
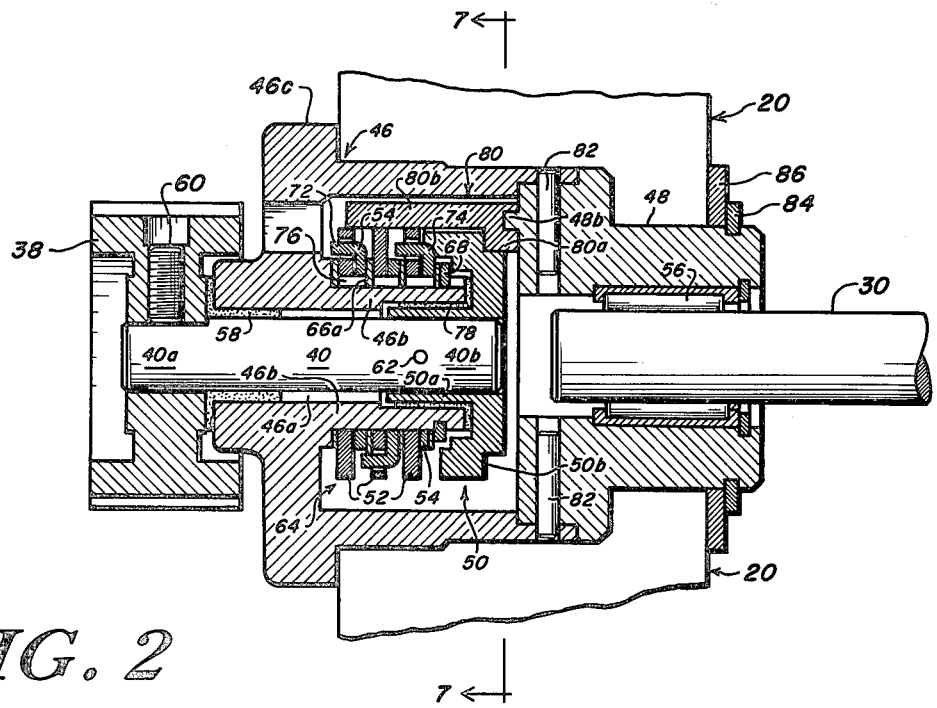
FIG. 2 is a detailed view in vertical section with portions in side elevation of the mechanical selector according to the present invention shown in FIG. 1.

In the embodiment shown in FIG. 2, the selector 44 includes a front housing 46, a back housing 48, the drive disc 50, combination discs 52, 52, 52, cam discs 54, 54, 54, and a one-way roller clutch 56 which grips an end of the roller shaft 30. The front housing 46 has a generally cylindrical, hollow configuration with a central aperture 46*a*. A flanged bearing 58 secured in the aperture 46*a* rotatably supports the input drive shaft 40. The end 40*a* of the drive shaft projects from the selector assembly and mounts the gear 38. A set screw 60 secures the timing pulley in a fixed position on the drive shaft. A dowel 62 secures the drive disk on the drive shaft and ensures that they rotate in unison.

The front housing 46 has a hollow, cylindrical hub 46*b* that extends from its outer front wall adjacent the gear 38 to a point spaced closely from the drive disc 50. An end portion of the hub 46*b* with a reduced outer diameter carries a combination mechanism 64 which includes three combination discs 52, three cam discs 54, three keyed anti-friction spacers 66 and a retaining ring 68 located at the far end of the hub 46*b* to secure all of the members 52, 54 and 66 on the hub in the mutually adjacent relationship as shown.

Figures 4, 5, 6, 7:
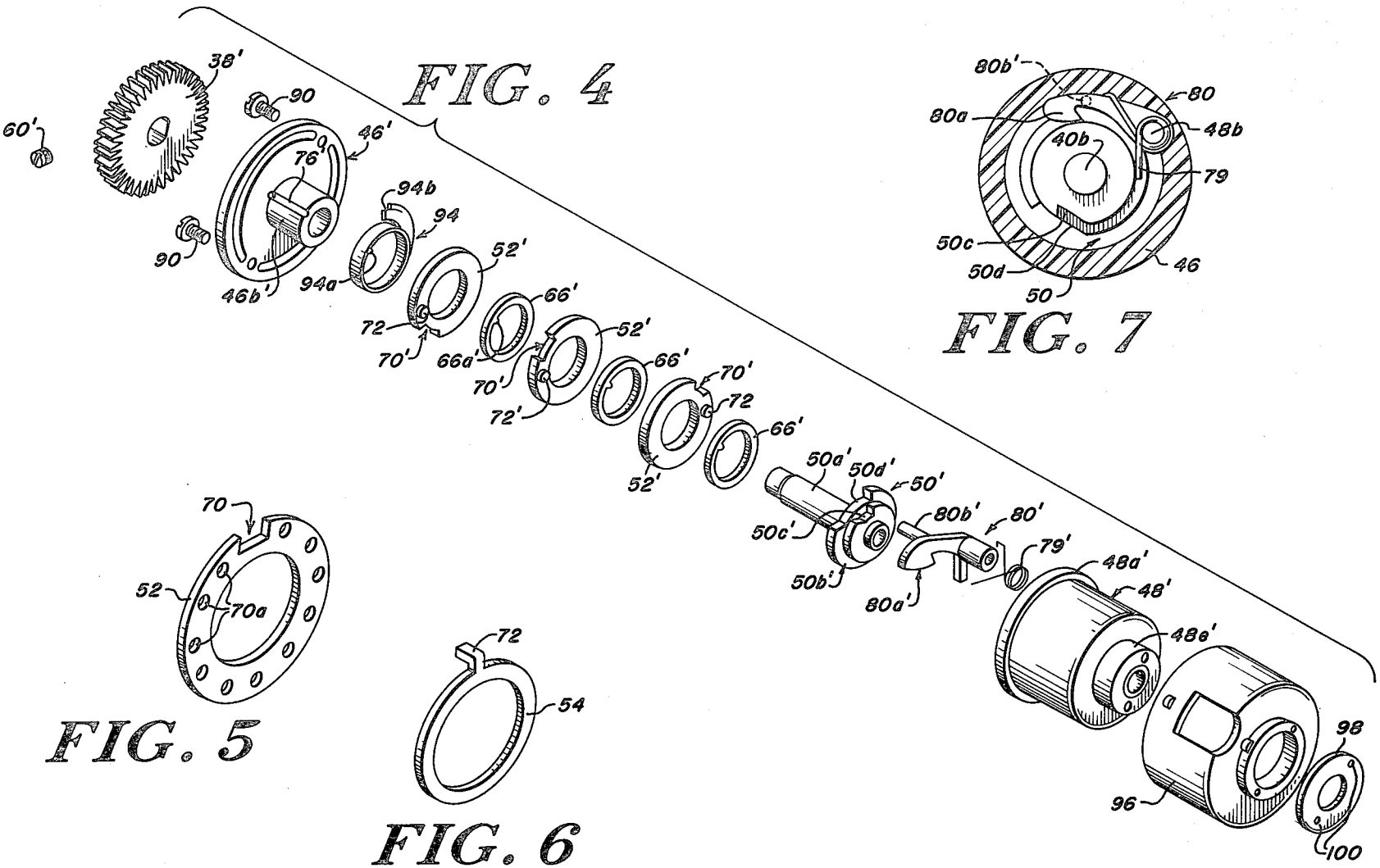
FIG. 4 is an exploded perspective view of the mechanical selector shown in FIG. 3.
FIG. 5 is a perspective view of a combination disc shown in FIG. 2.
FIG. 6 is a perspective view of a cam disc shown in FIG. 2.
FIG. 7 is a view in vertical section taken along the line 7—7 in FIG. 2 showing the power transmitting elements of the selector.

As is best seen in FIG. 5, each combination disc 52 has a generally annular configuration with a series of openings 70*a* formed in its body. In addition, there is an open recess 70 formed in the outer edge of each disc. As is best seen in FIG. 6, each cam disc 54 also has a generally annular configuration with a cam projection 72 that is oriented at right angles to the plane of the cam disk and dimensioned to penetrate one of the openings 70*a* in the combination disc. Each combination disk therefore has an associated cam disc received in a face-abutting relationship so that the projection 72 penetrates one of the openings. The particular opening 70*a* chosen "programs" or sets the "combination" of that combination and cam disc pair.

Rotations of the gear 38 are transmitted to the combination and cam discs through the drive disc 50 by means of a cam projection 74 formed on the drive disc 50. The cam projection 74 extends toward the combination and cam discs a sufficient distance so that during rotation of the drive disc 50, the cam projection 74 eventually abuts one side of the cam projection 72 of the "first" cam disc 54 (that is, the one closest to the cam projection 74). Further rotation of the drive disc 50 rotates the first cam disc 54 and the associated combination disc 52. This rotation will continue until the direction of rotation of the gear, drive shaft and drive disc are reversed. After reversal the cam projection 74 must rotate through almost a complete 360° before it engages the opposite side of the "first" cam disc projection 72. Continued "reverse" rotation causes a reverse rotation of that cam disc and the associated combination disc. The cam projection 72 extends in a direction parallel to the axis of rotation of the drive disc 50 a sufficient distance so that after continued rotation it will eventually engage the adjacent cam projection 72 of the "second" and adjacent cam disc 54. In this manner a programmed pattern of rotations of the input pulley and the drive disc can produce rotations of all of the combination discs 52.

If a "proper" pattern of rotations of the cam and combination discs is selected, it will place all of the combination discs in a position that allows a transmission of power through the selector 44 to the associated feed roll. This position is characterized by the open recesses of all of the combination discs being aligned with one another in a predetermined angular position. (This assumes that the combination mechanism has been initialized and therefore the combination discs begin their rotations from a known position). With a construction using one cam projection on each face of the combination discs, a "reverse" rotation through n complete revolutions will initialize the combination mechanism if it has n−1 combination discs. For the three combination discs shown, four complete reverse rotations will place all of the discs in a known starting position.

It should be noted that the spacers are keyed, that is, they each have a inwardly directed tab 66*a* which is received in a longitudinal key way 76 formed in the hub 46*b*. This arrangement prevents the spacers from rotating due to a frictional coupling with the adjoining elements which may be rotating. The spacers therefore ensure that rotational motion is transmitted from one disc pair to another only through the engagement of their associated cam projections 72. It should be noted that because drive disk 50 rotates with respect to the hub 46*b*, a low friction bearing 78 is interposed between the outer surface of the drive disc stem 50*a* and the inside end of the surface of the hub 46*b*. Also, the face of the drive disk adjacent the feed roll shaft 30 is preferably recessed at 50*b* to provide a clearance for the main power transmitting portion 80*a* of a pivoted lever 80 (best seen in FIG. 7).

The lever 80 provides the engagement mechanism for transmitting power to the drive shaft 30. It is pivotally mounted on a pin 48*b* and includes an arm 80*b* that extends over the combination discs and is generally parallel to the axis of rotation of the drive disc and the other rotating components of the selector. If a "proper" pattern aligns the recesses 70 in the correct location (and also aligns the recess 50*d* of the drive shaft with the recesses 70), the arm 80*b* of the lever 80 falls into the recesses 70 under the action of a spring 79. Engagement of the arm 80*b* causes the power transmitting pawl 80*a* to enter the mating recess 50*c* formed in the rear face of the drive disk 50. Once the pawl 80*a* is thus engaged, rotation of the input power drive train will also rotate the lever 80, the back housing 48, the front housing 46 secured to the back housing by dowel pins 82 and the roller clutch assembly 56 secured in the back housing 48. The direction of rotation for power transmission is selected such that the roller clutch 56 will transmit power to the drive shaft 30 when the pawl 80*a* is engaged in the recess 50*c* and the housing 46,48 rotates.

In contrast, if the proper pattern of rotations and counter-rotations is not applied to the combination discs, then the recesses 70 and 50*d* do not become aligned or do not become aligned in an angular position where the arm 80*b* can enter the recesses 70 and 50*d*.

The member 80*b* then rides on the outer surface of at least one of the combination discs. Since it cannot move into a lowered, power transmitting position, the pawl portion 80*a* of the lever 80 cannot engage the recess 50*c* of the drive disc to transmit power. In other words, the drive train of the gear 38, input shaft 40 and drive disk 50, together with the combination discs which rotate freely on the hub 46*b*, will all rotate in unison while the housing, the clutch 56 and the feed roller shaft 30 remain stationary. To facilitate rotation of the selector assembly when it is in the power transmitting mode, the housing portions can be mounted in a suitable bearing assembly (not shown in FIG. 2). The front housing portion has a flange 46*c* that abuts the outer wall of the associated cassette 20, 22 or 24. The rear housing 48 mounts a retaining ring 84 which secures a spacer 86 which in turn abuts the inner wall of the associated cassette housing (FIG. 2). The selector 44 is thereby securely mounted on the cassette.

Figure 3:
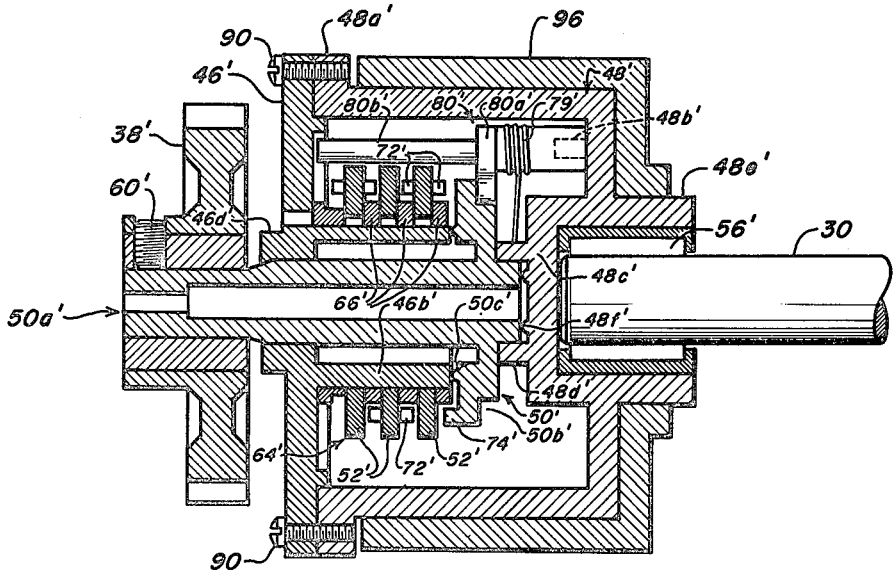
FIG. 3 is a view in vertical section and partially in side elevation corresponding to FIG. 2 and showing an alternative embodiment of the mechanical selector of the present invention.

FIGS. 3 and 4 illustrate an alternative, preferred embodiment of this invention which operates similarly to the embodiment shown and described with reference to FIG. 2. Like parts will be identified with the same reference numeral except that parts for the FIGS. 3 and 4 embodiment will be denoted by a prime (').

The mechanical selector 44' of this embodiment has a front housing portion 46' and a rear housing portion 48' that are secured to one another by a pair of screws 90,90 which penetrate the front housing and thread into a flange 48*a*' of the back housing. The rear housing 48' mounts a one-way roller clutch 56' that grips an end of an associated feed roll shaft 30. The clutch 56' is preferably housed in a generally cylindrical compartment 48*e*' of the back housing including a bottom wall 48*c*'. Power is supplied to the selector through a power input gear 38' which is secured directly to a stem 50*a*' of a drive disk 50' at an end portion which projects beyond the front housing 46'. A set screw 60' secures the gear to the stem. The stem is generally coaxial with the feed roll drive shaft 30 and rotates in a bushing 46*d*' and in a bearing 48*d*' formed on the housing wall 48*c*'. The "rear" face of the drive disc 50' contains a recess 50*b*' at its outer edge which provide a clearance for a pawl 80*a*' of a lever assembly 80' pivotally mounted to a post 48*b*' of the housing portion 48'. A spring 79' urges the lever 80' into engagement with the drive disc. The drive disc is preferably located axially by a circumferential ridge 48*f*' formed on the wall 48*c*' of the back housing and a similar circular ridge 50*c*' formed on the front face of the drive disc 50'. The ridge 48*f*' abuts the inner end of the stem 50*a*' and the ridge 50*c*' abuts the inner end of the cylindrical, hollow hub 46*b*'. The gear 38' together with the drive disk 50', including its stem portion 50*a*', comprise the input power train.

As in the FIG. 2 embodiment, the transmission of power is controlled by a set of combination discs 52' each having an open, peripheral recess 70' formed in its outer edge and adapted to receive an arm 80*b*' of the lever 80' when all of the recesses 70' are aligned with one another along the axis of rotation and under the arm. Spacers 66' separate the combination discs and are keyed to the hub 46*b*' to prevent the transmission of rotational motion from one combination disc to the other except through an engagement of cam pins 72' formed on opposite faces of the discs. A cam pin 74' formed integrally with the drive shaft 50*b*' projects towards the combination discs a sufficient distance to engage the facing cam pin 72' located on the "first" disc to provide a transmission of rotational motion from the gear 38' to the combination discs in the manner described above with respect to the FIG. 2 embodiment. A preselected pattern of rotations and counter-rotations of the gear 38' will result in rotations of all three cam discs so that the three recesses 70' and a recess 50*d*' in the drive disc are aligned beneath the arm 80*b*. The pawl 80*a*' then engages the drive disc 50' to rotate the housing portions 46' and 48' and therefore the feed roll shaft 30. If the proper sequence of rotations and counter-rotations of the combination discs does not occur, the recesses 70' are not properly aligned and the lever does not fall into the power engaging position. The drive disc 50' therefore rotates together with the combination disks 52', but the housing portions 46' and 48', the roller clutch 56' and the roller drive shaft 30 remain stationary.

The FIGS. 3 and 4 embodiment has several components which do not have direct analogs in the FIG. 2 embodiment. A ratchet spacer 94 (FIG. 4) is located on the hub 46*b*' and including a projection 94*a* similar to the projections 66*a*' on the spacer 66', all of which are engaged in the channel 76' formed on the outer surface of the hub 46*b*'. The ratchet spacer 94 spaces the "last" combination disk 52' from the front housing 46'. It also includes a portion 94*b* which extends radially and axially to a point where it can engage the cam pins 72' on the third combination disk 52' facing the front housing 46'. With this ratchet spacer, continued counter-rotation of the gear 38 will eventually drive the housing portions 46' and 48' also in a counter-rotating direction. The feed roller shaft 30, however, remains stationary because the one-way clutch 56' will not transmit power in a direction that is opposite to one which feeds a sheet of paper from the associated cassette.

Also, there is an outer race 96 which slides over and holds the back housing 48' in a freely rotatable relationship. A retaining ring 98 (FIG. 4) secured by screws passing through the holes 100,100 formed in the retaining ring to the portion 48*e*' of the back housing 48'. When the retaining ring 98 is thus secured, it has a slight overhang which also holds the housing portion 100 in a proper seated relationship with respect to the back housing.

One significant difference between the FIG. 2 embodiment and the FIGS. 3 and 4 embodiment is that the latter embodiment is preferably formed entirely of molded plastic which allows the parts to be injection molded. This has cost advantages over machining of metal parts. In addition, the parts are preferably formed of a plastic material having a low coefficient of sliding friction such as the products sold by the I. E. Dupont Denemours Company under the trade designation Delrin. The moving parts are also preferably lubricated by a coating of a suitable plastic lubricant of a type well known to those skilled in the art.

A second significant difference between the two embodiments is that combination discs 52' carry the cam projections 72' as pins or projections formed on their faces rather than as separate cam disc elements 54 with cam projections 72. This arrangement has this advantage in that the position of the pins 72' and the recesses 70' are fixed and therefore each mechanical selector has the same "combination" that is, the same pattern of forward and reverse rotations will place the recesses 70' in the same position (assuming that the selectors have been initialized). This arrangement offers obvious economies of manufacture.

With the FIGS. 3 and 4 embodiment, therefore, the gear train 36 provides the necessary unique association between a selector 44' and the pattern of forward and reverse movements of the drive shaft 36. As noted above, because of the variations in the diameters of the gears 136, 138 and 140 they have different tangential displacements for the same angular displacement. When these gears are meshed with identical gears 38', 38', 38' of the selectors, the same forward or reverse movements of the drive shafts will produce rotations of the gears 38', 38', 38' in the same direction, but of varying angular displacements. For example, the drive train 36 can produce a one-to-one ratio for the rotation of the gear 38' associated with one mechanical selector but a two-to-one ratio for another gear 38' associated with a second selector. As a result, a motion of the drive shaft which carries the first gear 38' through a full 360° rotation will produce only a 180° rotation of the second gear 38'. Therefore, only a proper, preselected sequence will "engage" the desired selector and its associated feed roll, while leaving the other selectors in a disengaged mode with no power transmission to their associated feed rolls. In contrast, if selectors of the type shown in FIG. 2 are used, then the form of the power transmission to the selectors is less important. Each selector can be rotated in the same manner by the drive system, but because they have different combinations (the orientation of the cam discs with respect to their associated combination discs) they will react differently to the same pattern of rotations and counter-rotations.

The present paper feed system thus has many advantages over known systems. It allows a simple "drop-in" loading of cassettes which automatically couples the cassette to a drive train. It avoids manual electrical connections between a cassette and a printer, or even the operation of switches. It offers a highly reliable, mechanical system for rapidly selecting only one of multiple cassettes to feed cut sheet paper. It offers all these advantages while avoiding the problems attendant the movement of large components at high speed, the shifting of major elements of the paper feed system, or any significant redesign of certain known printers using cut sheet paper.

While the invention has been described with respect to its preferred embodiments it will be understood that these and other various other modifications and variations will occur to those skilled in the art from the foregoing detailed description of the accompanying drawings. The following claims are intended to cover any such modifications or variations.

What is claimed is:

1. In a printer having a plurality of cassettes that each hold a supply of cut sheet paper and have an integral paper feed roll for said cut sheets, the improvement comprising a mechanical system for selectively operating the feed roll of only a selected one of said cassettes, said mechanical system comprising, a frame secured on said printer that replaceably holds said plurality of cassettes in a paper feeding position, drive means for said paper feed rolls mounted in said frame, said drive means being operable in forward and reverse directions, a plurality of mechanical selector means each mounted in an associated one of said cassettes and operatively engaged to said drive means when said cassettes are held in said frame, each of said selector means including combination means operable through a series of rotations and counter-rotations, said selector means operating in response to a preselected series of rotations and counter-rotations of said combination means to transmit power from said drive means to an associated feed roll, and means for uniquely associating a programmed sequence of movements of said drive means in said forward and reverse directions with said preselected sequence of rotations and counter-rotations whereby one of said combination means and its associated selector means is selected for said power transmission.

2. The mechanical selection system according to claim 1 wherein said associating means comprises (i) a gear operatively coupled to said combination means that follows the movement of said drive means and (ii) cam means forming a portion of said combination means where the angular location of said cam means with respect to said combination means controls the operation of said combination means in response to said movements of said drive means.

3. The mechanical selector means of claim 1 wherein said associating means comprises a gear operatively coupled to said combination means, a gear train that produces a proportionate rotation of said pulley means in response to a movement of said drive means where said rotational proportion is uniquely associated with one of said cassettes.

4. The mechanical selector means of claim 3 wherein the combination means of each of said selector means is identical.

5. The mechanical selector means claim 1 wherein said combination means includes a set of disc members mounted for rotation about a common axis, said disc members being mutually spaced from one another, and cam means secured on said disc members so that continuted rotation of said one of disc members in a given rotational direction will cause cam means on adjacent disc member to transmit rotational movement of the disc members.

6. The mechanical selector system of claim 5 wherein said cam means comprises projections from the faces of said disc members.

7. The mechanical selector means according to claim 6 wherein said disc members include a plurality of angularly spaced openings and said cam means comprises an associated annular member with a projection extends through an associated one of said openings.

8. The mechanical selector system according to claim 7 wherein said disc members each include an open recess formed on its outer periphery.

9. The mechanical selector means according to claim 8 wherein said open grooves associated with each of said disc members are aligned after said preselected sequence of rotations and counter-rotations.

10. The mechanical selector means according to claim 9 wherein said mechanical selector means includes power engagement means movable between an engaged position and a disengaged position, said power engagement means providing said operative coupling between said drive means and said selected feed roll when said open recesses are aligned.

11. The mechanical selector means according to claim 10 wherein said power engagement means includes a pawl pivotedly mounted at one end and an engagement arm that extends over said combination discs and adapted to be received in said open recesses.

12. The mechanical selector means according to claim 10 wherein said mechanical selector means includes a housing that encloses said combination means and said power engagement means.

13. The mechanical selector means according to claim 1 wherein said mechanical selector means further comprises a drive disc operatively coupled to said drive means, said drive disc being rotatable about a common axis of rotation with said combination means.

14. The mechanical selector system according to claim 13 wherein said drive disc includes means for operatively coupling said drive disc to said combination means.

15. The mechanical selector system according to claim 14 wherein said combination means includes a set of mutually spaced apart disc members that are rotatable about a common axis and cam means carried on said discs for transmitting rotational motion from one disc to an adjacent disc when their associated cam means are engaged with one another, and wherein said coupling means comprises a cam element formed on said drive disc that can engage the cam means of the adjacent disc member.

16. The mechanical selector means according to claim 12 wherein said housing includes means for securing a drive shaft of an associated one of said feed rollers.

17. The mechanical selector means according to claim 16 wherein said securing means comprises a one-way roller clutch.

18. The mechanical selector means according to claim 12 further comprising means for urging said power engagement means towards said power engaging position.

19. In a printer that includes at least one paper feed roll that rotates under the control of a data source to print on cut sheet paper fed from multiple cassettes, each of said cassettes having a paper feed roll rotatably mounted in the cassette to feed the top sheet of the paper supply held in the cassette to the printer when the paper feed roll rotates in a forward direction, wherein the improvement comprises:

a frame mounted on said printer that replaceably receives and supports the multiple cassettes in a generally vertical orientation, a cassette drive system mounted on said frame, said drive system having a common rotating power input from said printer paper feed roll and extending generally horizontally along said frame to provide a power output to each of the multiple cassettes when they are held in said frame, and a mechanical selector means mounted in each of the multiple cassettes that transmits rotational motion from said drive means to the associated one of said cassette paper feed rolls provided that a programmed sequence of forward and reverse rotations is applied to said selector means by said drive means, said selector means automatically engaging said drive means when said cassette is held in said frame in a fully seated position.

20. The improved paper feed system according to claim 19 wherein said frame has at least one side wall and said drive means comprises a gear train mounted on said side wall.

21. The improved paper feed system according to claim 20 wherein said gear train includes multiple power output gears located to drive the selector means associated with each of said cassettes, and wherein said gear train rotates said power output gears at different peripheral speeds.

22. The improved paper feed system according to claim 21 wherein said selector means each includes a power input gear that engages an associated one of said power output gears when said cassettes are held in said frame.

23. The improved paper feed system according to claim 19 wherein said frame includes multiple guide slots secured to a side wall of said frame and the cassettes each include insert guide means secured on an outer side surface, said insert guide means being vertically slidable within an associated one of said guide slots.

24. The improved paper feed system according to claim 23 further comprising detent means to locate and secure said insert guide in said fully seated position in said guide slot.

* * * * *